United States Patent [19]

Kunihisa

[11] Patent Number: 4,973,095

[45] Date of Patent: Nov. 27, 1990

[54] INTERCONNECTED CHOPSTICKS

[76] Inventor: Richard Kunihisa, 777 Kapiolani Blvd., Honolulu, Hi. 96813-5211

[21] Appl. No.: 365,695

[22] Filed: Jun. 14, 1989

[51] Int. Cl.[5] ..... A47G 21/10; A47J 43/28; B25J 1/02

[52] U.S. Cl. ..... 294/99.2; 294/33

[58] Field of Search ..... 294/3, 5, 8.5, 11, 16, 294/33, 99.2, 100, 103, 104, 106; 30/135, 142, 150; 128/321, 346, 354; D7/105; 606/205, 206, 208, 210

[56] References Cited

U.S. PATENT DOCUMENTS

| | | | |
|---|---|---|---|
| D. 221,707 | 8/1971 | Shannon | D83/12 |
| D. 263,502 | 3/1982 | Tartaglia | D24/27 |
| 606,372 | 6/1898 | Bradley | 294/99.2 X |
| 2,685,880 | 8/1954 | Curutchet | 294/99.2 X |
| 2,711,339 | 6/1955 | McGogy | 294/99.2 |
| 3,392,727 | 7/1968 | Hanlon | 294/99.2 X |
| 3,653,389 | 4/1972 | Shannon | 128/354 |
| 3,889,995 | 6/1975 | Lin | 294/99.2 |
| 3,892,435 | 7/1975 | Huey | 294/99.2 |
| 3,934,915 | 1/1976 | Humpa | 294/99.2 |
| 3,977,410 | 8/1976 | Huston et al. | 294/99.2 X |
| 4,199,180 | 4/1980 | Kelly | 294/99.2 X |
| 4,318,313 | 3/1982 | Tartaglia | 294/99.2 |
| 4,461,297 | 7/1984 | Sutter | 294/99.2 X |
| 4,659,128 | 4/1987 | Dong | 294/99.2 |
| 4,787,663 | 11/1988 | Laramie | 294/99.2 |

FOREIGN PATENT DOCUMENTS

| | | | |
|---|---|---|---|
| 1199192 | 1/1986 | Canada | 294/99.2 |
| 970872 | 1/1951 | France | 294/99.2 |
| 76191 | 1/1950 | Norway | 294/99.2 |
| 2065454 | 7/1981 | United Kingdom | 294/99.2 |

*Primary Examiner*—Johnny D. Cherry

*Attorney, Agent, or Firm*—Fleit, Jacobson, Cohn, Price, Holman & Stern

[57] ABSTRACT

Two parallel chopsticks are interconnected by a transversely extending spring member which extends directly across between the two chopsticks to form a perpendicular extension from one chopstick which directly interconnects with the other chopstick. An ornamental design may extend from opposite edges of the transverse interconnecting member in a direction extending parallel to the chopsticks. The spring member is designed to give the correct feel for use of chopsticks. The cross-section of the spring member can be modified to give this correct feel. An additional feature is a guide locking member which interconnects the two chopsticks approximately at their mid-points.

1 Claim, 1 Drawing Sheet

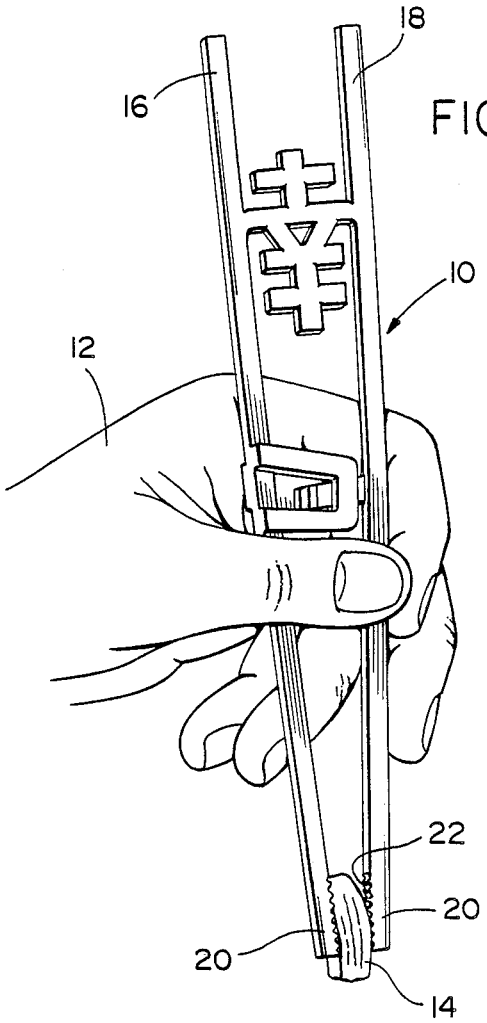
FIG. 1
FIG. 2
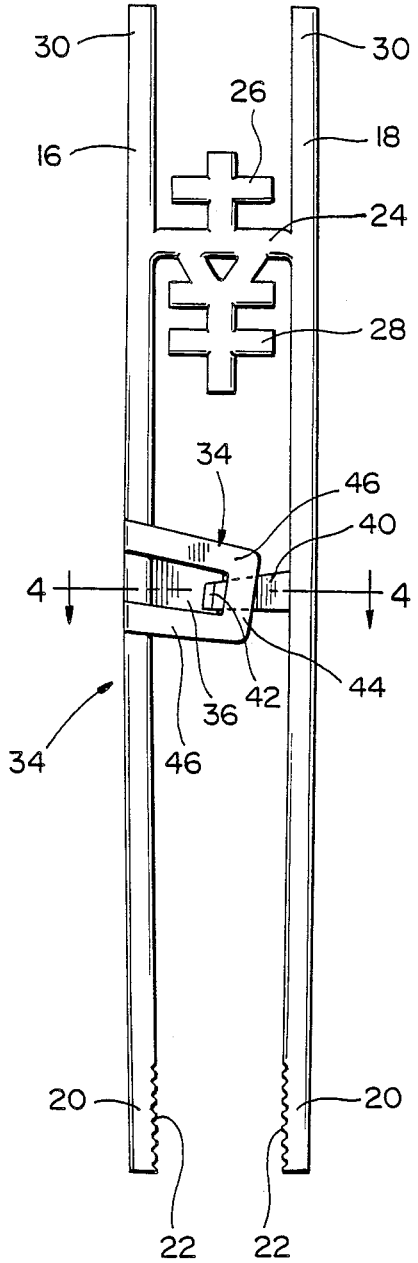
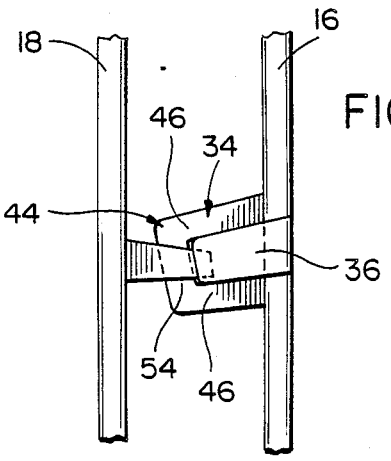
FIG. 3
FIG. 4
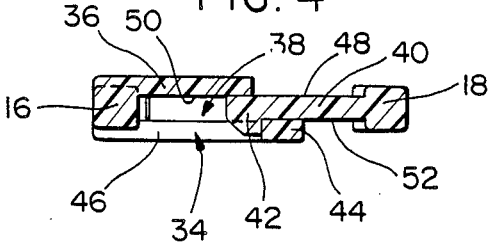

INTERCONNECTED CHOPSTICKS

FIELD OF THE INVENTION

The present invention involves the use of chopsticks for picking up and eating of food.

BACKGROUND OF THE INVENTION

Many persons visiting oriental-style restaurants wish to totally immerse themselves in an exotic food experience. This may be accomplished by the use of chopsticks for the picking up and eating of the food. However, the chopsticks usually provided to the restaurant goer are traditionally two separate pieces of wood, bamboo or plastic. Practice is usually required before the technique of eating with chopsticks is mastered.

Infrequent visitors to oriental restaurants often times have problems in the use of chopsticks which adversely affects their dining experience. An attempt to eliminate the adverse conditions experienced by infrequent restaurant visitors to oriental-style restaurants is available under the trade name "INSTANT CHOPSTICKS." These chopsticks include the marking "PAT. APPL. 06/135,615."

These chopsticks are approximately eight inches in length. They include serrated edges at one end of each chopstick. At a point approximately five inches from the end of the chopsticks including the serrated edges, is a lateral projection which extends approximately one-half inch from each chopstick towards the other chopstick. The projections then turn 90° and extend parallel to the chopsticks for approximately one and one-half inches in a direction away from the serrated edge end of the chopsticks. The parallel-extending projections then turn again at an angle of 90° towards each chopstick and form a single piece of an approximately one inch length which interconnects the two parallel-extending portions. The two chopsticks are thereby held at a distance of approximately one and one-half inches from each other.

The disadvantage of these chopsticks is that during movement towards and away from each other, it is possible for the chopsticks to twist with respect to each other, so as when the chopsticks are moved towards each other the serrated edge ends may pass by each other causing breakage of the interconnecting portion of the two chopsticks. Further, when moving the two chopsticks away from each other it is also possible to move the chopsticks a sufficient distance apart so as to break the laterally extending interconnection of the two chopsticks.

SUMMARY OF THE INVENTION

Accordingly, it is an advantage of the present invention to avoid the problems encountered by the "INSTANT CHOPSTICKS."

By the present invention, two parallel chopsticks are interconnected by a transversely extending spring member which extends directly across between the two chopsticks to form a perpendicular extension from one chopstick which directly interconnects with the other chopstick. An ornamental design may extend from opposite edges of the transverse interconnecting member in a direction extending parallel to the chopsticks. The spring member is designed to give the correct feel for use of chopsticks. The crosssection of the spring member can be modified to give this correct feel.

An additional feature of the present invention is a guide locking member which interconnects the two chopsticks approximately at their mid-points. The locking member prevents a person from opening the two chopsticks to an extent so as to avoid breaking of the spring member which interconnects the two chopsticks. In addition, the locking members prevent the two chopsticks from twisting relative to each other when a person is using the chopsticks. The two chopsticks are thereby continuously aligned to facilitate picking up food. Finally, the locking members allow the chopsticks when assembled together to have a pre-tension to keep the ends of the chopsticks, which also have serrated edges, apart until a person is ready to pick up their food with the chopsticks of the invention.

It is an object of the present invention to provide parallel-extending chopsticks in a position of rest which are interconnected by a transversely extending spring member and locking members located at a mid-point of each chopstick.

It is another object of the present invention to provide parallel-extending chopsticks in a position of rest which are interconnected by a transversely extending spring member and locking members located at a mid-point of each chopstick so that the spring member provides a correct feel for usage of the chopsticks.

It is yet another object of the present invention to provide parallel-extending chopsticks in a position of rest which are interconnected by a transversely extending spring member and locking members located at a mid-point of each chopstick so that the spring member provides a correct feel for usage of the chopsticks in which the spring members prevent a person from opening the two chopsticks so as to avoid breaking of the spring member, for guiding the chopsticks during movement towards and away from each other so as to prevent twisting and for allowing the chopsticks when assembled together to have a pre-tension which keeps the operative ends of the chopsticks a predetermined distance apart until ready to pick up food.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of the invention shown in use for picking up foods.

FIG. 2 is a front view of the assembled chopsticks.

FIG. 3 is a partial view of the rear side of the chopsticks illustrating the locking members.

FIG. 4 is a sectional view taken along line 4—4 of FIG. 2.

DETAILED DESCRIPTION OF THE PREFERRED EMBODIMENTS

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1, in particular, a pair of chopsticks embodying the teachings of the subject invention is generally designated as 10. The chopsticks are held in the operators hand 12 and are used to pick up food 14. It is noted that there is no special manner in which the chopsticks are operated. It is only important that pressure be applied on one chopstick so as to move that chopstick towards the other chopstick which is held stationary or which is also moved towards the one chopstick while locating one end of each chopstick on opposite sides of food 14.

The pair of chopsticks 10 includes elongated chopsticks 16 and 18 made of an injection moldable plastic. At the ends 20 of each chopstick are a series of serrations 22 which aid in gripping food.

A spring member 24 extends between and substantially perpendicular to chopsticks 16 and 18. Projecting laterally from the spring member 24 are character decorations 26 and 28. These character decorations are for design purposes only.

The spring member 24 is designed to produce a springingness between the ends 20 of the chopsticks 16 and 18 which is adjustable by changing the cross-section of the spring member during manufacture. The spring member is located adjacent to end 30 of chopsticks 16 and 18.

Locking member 32 is formed of three elements projecting laterally at the approximate mid-section of the chopsticks 16 and 18. Lateral projection 34 is U-shaped, having legs 46 and cross-piece 44, and projects from chopstick 16. Similarly, lateral projection 36 in the approximate form of a rectangle shape projects from an opposite side of chopstick 16 as compared to projection 34. Projections 34 and 36 extend substantially parallel from chopstick 16. In a gap 38 formed between projections 34 and 36 extends lateral projection 40 having hook-shaped end 42 which extends perpendicular to the projection 40 from an end of projection 40, opposite to the end connected to chopstick 18. The hook end 42 engages with cross-piece 44 of projection 34 which interconnects the legs 46 of the U-shaped projection 34.

The pair of chopsticks 10 is made by injection molding of rigid plastic. In the form, as removed from the mold, the ends 20 of the chopsticks are divergent and the ends 30 are convergent with the projection 40 spaced away from crosspiece 44.

To assemble the chopstick unit, the ends 20 of chopsticks 16 and 18 are moved towards each other until the hook end 42 of lateral projection 40 engages, slides over and hooks behind the cross-piece 44. The hook end 42 will thereafter remain in the gap 38 formed between the projections 34 and 36.

The pressure of ends 20 of chopsticks 16 and 18 to diverge away from each other is restrained by the hook end 42 engaging the cross-piece 44 as shown in FIG. 4. The spring member 24 naturally urges the ends 20 of the chopsticks away from each other to facilitate a constant rest position opening between the ends 20 so as to permit a space between the ends 20 of the chopsticks for picking up of food.

In addition, the hook end 42 engaging the cross-piece 44 prevents a person from spreading the ends 20 of the chopsticks 16 and 18 apart so as to avoid breakage of the spring member 24. Further, since the side 48 of projection 40 slides against the inner side 50 of the projection 36 and the side 52 of the projection 40 slides along the inner side 54 of the cross-piece 44, during manual movement of the ends 20 of the chopsticks 16 and 18 towards each other, the chopsticks 16 and 18 are prevented from twisting relative to each other due to overpressurization of the ends 20 against a piece of food. The locking members thereby greatly facilitate the use and prevention of breakage of the chopsticks 10.

Having described the invention, many modifications thereto will become apparent to those skilled in the art to which it pertains without deviation from the spirit of the invention as defined by the scope of the appended claims.

I claim:

1. A chopstick assembly comprising:

a pair of chopsticks, a spring member interconnecting said pair of chopsticks to space said chopsticks away from each other and for biasing one end of each of said chopsticks away from each other, and locking means interconnecting said pair of chopsticks (1) for resisting the bias of said spring member, (2) for preventing twisting of said chopsticks relative to each other and (3) for preventing excessive movement of said one end of said chopsticks away from each other which would cause breakage of said spring member, said locking means including a first projection extending laterally from one of said chopsticks towards the other of said chopsticks, a second projection extending laterally from said one chopsticks and towards said other chopstick, and a third projection extending laterally from said other chopstick towards said one chopstick, said first projection being U-shaped and having two legs interconnected at one end by a crosspiece, a free end of each of said two legs being connected to said one chopstick, said second projection extending parallel to said first projection and spaced from said first projection to form a gap, said third projection having, at a free end opposite to an end connected to said other chopstick, a hooked-shaped end extending perpendicular to said third projection, said hook-shaped end engaging said crosspiece due to the bias of said spring member on said chopsticks and said hook-shaped end being moveable to engage said one chopstick to limit movement of the chopsticks with respect to each other and said third projection being located in said gap between said first projection and said second projection and said third projection slidingly engaging said first projection and said second projection when said chopsticks are moved toward each other to prevent twisting of said chopsticks relative to each other.

* * * * *